US010094136B2

(12) United States Patent
Konduc et al.

(10) Patent No.: US 10,094,136 B2
(45) Date of Patent: Oct. 9, 2018

(54) DRILLING RIG SYSTEM WITH SELF-ELEVATING DRILL FLOOR

(71) Applicant: DRECO ENERGY SERVICES ULC, Edmonton (CA)

(72) Inventors: Kameron Wayne Konduc, Edmonton (CA); Donald Leonard Burlet, Edmonton (CA)

(73) Assignee: DRECO ENERGY SERVICES ULC, Edmonton (CA)

( * ) Notice: Subject to any disclaimer, the term of this patent is extended or adjusted under 35 U.S.C. 154(b) by 231 days.

(21) Appl. No.: 15/255,740

(22) Filed: Sep. 2, 2016

(65) Prior Publication Data

US 2016/0369523 A1 Dec. 22, 2016

Related U.S. Application Data

(60) Continuation of application No. 14/527,537, filed on Oct. 29, 2014, now Pat. No. 9,458,675, which is a (Continued)

(51) Int. Cl.
*E21B 15/00* (2006.01)
*E04H 12/34* (2006.01)

(Continued)

(52) U.S. Cl.
CPC ..... *E04H 12/344* (2013.01); *E04B 1/34331* (2013.01); *E04B 1/34384* (2013.01);

(Continued)

(58) Field of Classification Search
CPC ..... E04H 12/344; E04H 12/18; E04H 12/345; E21B 15/00

(Continued)

(56) References Cited

U.S. PATENT DOCUMENTS 3,228,151 A 1/1966 Woolslayer et al.
3,327,997 A 6/1967 Zenke (Continued)

FOREIGN PATENT DOCUMENTS

RU 81516 U1 3/2009
RU 96904 U1 8/2010

(Continued)

OTHER PUBLICATIONS

Written Opinion of the International Searching Authority re PCT/CA2012/000510 (dated Aug. 24, 2012).

(Continued)

*Primary Examiner* — Taras P Bemko
(74) *Attorney, Agent, or Firm* — Conley Rose, P.C.

(57) ABSTRACT

A transportable drilling rig having a self-elevating drill floor includes a base structure comprising multiple base towers that can be transported to a wellsite and positioned around an intended wellbore location. A horizontal base frame is installed between lower regions of the towers to form a stable rig base structure, and a drill floor can then be constructed over the base frame and between the base towers. A suitable rig mast can then be erected on the drill floor. Floor-lifting cables are anchored to upper regions of the base towers and disposable around corresponding sheave assemblies associated with the drill floor. The free ends of the floor-lifting cables can be engaged by the traveling block in the rig mast, whereupon the rig's drawworks can be actuated to elevate the drill floor and mast as required and then locked to the base towers.

14 Claims, 8 Drawing Sheets

Related U.S. Application Data division of application No. 13/487,186, filed on Jun. 2, 2012.

(60) Provisional application No. 61/492,786, filed on Jun. 2, 2011.

(51) Int. Cl.
*E04B 1/343* (2006.01)
*E04H 12/18* (2006.01)

(52) U.S. Cl.
CPC ..... *E04H 12/18* (2013.01); *E04H 12/345* (2013.01); *E21B 15/00* (2013.01)

(58) Field of Classification Search
USPC ..... 166/374
See application file for complete search history.

(56) References Cited

U.S. PATENT DOCUMENTS

| | | | |
|---|---|---|---|
| 3,333,377 | A | 8/1967 | Woolslayer et al. |
| 3,828,513 | A | 8/1974 | Vanderklaauw |
| 3,922,825 | A | 12/1975 | Eddy et al. |
| 3,942,593 | A | 3/1976 | Reeve et al. |
| 4,128,229 | A | 12/1978 | Elliston |
| 4,375,241 | A | 3/1983 | Gallon |
| 4,587,778 | A | 5/1986 | Woolslayer et al. |
| 4,831,795 | A | 5/1989 | Sorokan |
| 5,954,453 | A | 9/1999 | Thomas |
| 6,045,297 | A | 4/2000 | Voorhees et al. |
| 6,634,436 | B1 | 10/2003 | Desai |
| 6,994,171 | B2 | 2/2006 | Orr et al. |
| 7,765,749 | B2 | 8/2010 | Paladis |
| 7,931,076 | B2 | 4/2011 | Ditta et al. |
| 8,047,303 | B2 | 11/2011 | Donnally et al. |
| 8,468,753 | B2 | 6/2013 | Donnally et al. |
| 8,516,751 | B2 | 8/2013 | Konduc et al. |
| 8,549,815 | B2 | 10/2013 | Donnally et al. |
| 8,555,564 | B2 | 10/2013 | Wasterval |
| 8,556,003 | B2 | 10/2013 | Souchek |
| 2002/0185319 | A1 | 12/2002 | Smith |
| 2003/0172599 | A1 | 9/2003 | Frink |
| 2009/0000218 | A1 | 1/2009 | Lee et al. |
| 2010/0150660 | A1 | 6/2010 | Nadarajah et al. |
| 2011/0072737 | A1 | 3/2011 | Wasterval |

FOREIGN PATENT DOCUMENTS

| | | | |
|---|---|---|---|
| SU | 1461858 | A1 | 2/1989 |
| WO | 2009002189 | A1 | 12/2008 |
| WO | 2010132174 | A1 | 11/2010 |

OTHER PUBLICATIONS

Formal Response to Written Opinion of the International Searching Authority re PCT/CA2012/000510 (dated Mar. 14, 2013).

DRILLING RIG SYSTEM WITH SELF-ELEVATING DRILL FLOOR

FIELD OF THE DISCLOSURE

The present disclosure relates in general to rig structures for drilling wells such as oil and gas wells. In particular, the disclosure relates to rig structures that can be readily transported, rapidly erected, and rapidly disassembled, and further relates to methods for erecting such rig structures.

BACKGROUND

Wells for the recovery of hydrocarbons or minerals from a subsurface formation are commonly drilled by connecting a drill bit onto the lower end of an assembly of drill pipe sections connected end-to-end (commonly referred to as a "drill string"), and then rotating the drill string so that the drill bit progresses downward into the earth to create the desired wellbore. The drill string is typically rotated by means of a "rotary table" or a "top drive" associated with a drilling rig erected at the ground surface over the wellbore.

The primary components of a typical drilling rig include a base support structure, a drill floor, and a mast (also called a derrick) supported on and extending upward from the drill floor. The drill floor is typically elevated well above the ground surface to provide space to accommodate and allow access to various equipment required for drilling operations. An arrangement of pulleys (sheaves) called a crown block is mounted to the top of the rig mast. Hoisting apparatus called a drawworks, comprising a cable drum, a cable winch, and ancillary equipment, is provided in association with the drill floor. Wire-rope cable is fed from the cable drum up to the crown block and threaded over the various sheaves in the crown block, and then down to a "traveling block", which is an assembly of sheaves that is free to move vertically within the mast structure as the wire-rope cable ("drill line") is played out or taken up by the cable winch and drum of the drawworks. The traveling block has a lifting hook to support equipment used to raise and lower the drill string, and to add pipe sections during drill string assembly (or "make-up") and to remove pipe sections during drill string disassembly ("break-out"). For drilling operations using a top drive instead of a rotary table to rotate the drill string, the top drive is suspended from the traveling block hook.

For optimal efficiency and economy in well-drilling operations, it is desirable for drilling rigs to be readily transportable, rapidly erected, and rapidly disassembled for transportation to new wellsites. Accordingly, the transportability of rig components and the speed at which components can be assembled with the minimum amount of auxiliary equipment are paramount concerns. Conventional types of transportable rigs may require auxiliary support equipment to facilitate the erection and disassembly of large components such as the base, the drill floor, and the pipe racking board, thereby increasing rig set-up, take-down, and operational costs.

Numerous types of transportable rigs may be found in the prior art. Known transportable rigs commonly feature what is called a "bootstrap mast". A bottom mast section having a large lower opening on one side is mounted to the drill floor, using a mobile crane. The crane then lowers the top section of the finished mast (housing the crown block) into the bottom mast section, and the top mast section is temporarily pinned to the bottom mast section. Next, the crane positions an intermediate mast section through the opening in the bottom mast section so that the upper end of the intermediate mast section can be securely connected to the lower end of the upper mast section. The traveling block is then lowered to engage and support the intermediate section, the upper mast section is unpinned from the bottom mast section, the drawworks is actuated to hoist the upper and intermediate mast sections a distance corresponding to the height of the intermediate mast section, and then the partially-constructed mast assembly (i.e., upper section plus one intermediate section) is temporarily pinned to the stationary bottom mast section. This latter process is then repeated as necessary to install additional intermediate mast sections until the mast has reached its intended final height, whereupon the lowermost intermediate mast section is secured to the bottom mast section so that the rig is ready to be put into service.

Drilling sites are often located in remote areas requiring truck transportation of rig components and equipment required for rig assembly (or "rig-up"). Further complicating the rig-up process is the common need to relocate the rig to a more promising site after a wellbore has been drilled and it has been determined that the wellbore will not be sufficiently productive to warrant completion and operation of the well. Wellsite changes can occur once every several months, and, in response, prior art rig systems have attempted to increase the mobility of rig components and the efficiency of rig erection and disassembly procedures in order to minimize associated costs. However, the need for auxiliary equipment typically remains necessary for performing steps such as placing the drill floor.

Since the variable costs associated with leased support equipment, such as cranes and the like, are calculated on a per-hour or per-day basis, expediting rig take-down, transport, and set-up operations is crucial for minimizing equipment leasing costs. Typically, rig take-down and set-up times are in the order of days, and very large equipment and labor costs can be incurred for each end of a set-up and take-down operation. Various prior art drilling rigs are geared towards facilitating rapid set-up, take-down and transport, but they still require auxiliary equipment such as external cranes and external winches, which most often need to be leased and therefore increase overall rig set-up and take-down costs, particularly for remote wellsites.

One approach to reducing rig set-up times and costs is to raise the drill floor to its intended service elevation after erection of the mast. This results in economies due to the fact that the mast can be erected with the drill floor close to ground level rather than in its final position 20 feet or more above ground. The cranes and other equipment manipulating and positioning the various drill floor and mast components do not require as high a reach, and workers have more ready access to the drill floor during rig-up procedures.

An example of a transportable drilling rig having a drill floor that can be raised after mast erection can be seen in U.S. patent application Ser. No. 12/492,980 (Wasterval), Pub. No. US 2012/0326734A1. Wasterval teaches the construction of a drill floor over a base structure, which is provided with hydraulic cylinders for raising the drill floor above the base structure. After the drill floor has been raised by an increment corresponding to the stroke of the hydraulic cylinders, a first set of box beams are disposed between the drill floor and the base structure, and the box beams are anchored to the drill floor. The lift cylinders on the base structure can then be retracted to engage lift points on the box beams. The lift cylinders are then actuated again, this time to raise both the drill floor and the first box beams anchored thereto. This allows insertion of a second set of box beams between the base structure and the first set of box beams, thus elevating the drill floor a further incremental amount. This procedure is repeated as necessary to install additional sets of box beams until the drill floor has reached its intended elevation.

The Wasterval system thus allows the drill floor to be erected or constructed close to ground level, followed by erection of the rig mast on the drill floor, whereupon the drill floor (with erected mast) can be elevated as required. However, this system has an inherent drawback in that the rig floor raising procedure has to be carried out in incremental and comparatively complex stages, and is correspondingly complex and time-consuming. In addition, the Wasterval system entails the provision of a robust hydraulic system, which might not otherwise be needed on site during rig-up, and thus increases rig-up costs. As well, the Wasterval system requires the use of mobile cranes or other auxiliary hoisting equipment to manipulate and position the box beams, further adding to rig-up costs.

For the foregoing reasons, there is a need for an improved transportable drilling rig that can be rapidly erected and disassembled with minimal need for auxiliary equipment. In particular, there is a need for an improved transportable rig in which the drill floor can be elevated after erection of the mast, but without requiring hydraulics or auxiliary hoisting equipment.

BRIEF SUMMARY

In general terms, the present disclosure teaches a transportable drilling rig apparatus having a drill floor that can be elevated after erection of the rig mast, without requiring a hydraulic system or auxiliary hoisting equipment. In one embodiment, the rig's traveling block and drawworks are used to elevate the drill floor. In alternative embodiments, a worm gear drive mechanism can be used to elevate the drill floor. In all embodiments, the apparatus is configured such that the path followed by the drill floor as it is being elevated is a linear vertical path; i.e., a straight path perpendicular to the ground surface.

The rig apparatus includes a rig base structure comprising a plurality of base towers that can be positioned in a suitable spaced relationship on a wellsite. In one embodiment, there are four base towers arranged in a square or rectangular pattern, but other embodiments could use more than four towers and as few as three, and possibly in different (i.e., non-rectilinear) patterns. A generally horizontal base frame is installed between lower regions of the towers, thus tying the towers together to form a suitably rigid and stable rig base structure. The towers may be provided with height adjustment mechanisms (e.g., hydraulic jacks) to facilitate leveling the base structure over uneven ground surfaces. As well, the towers may optionally be provided with "walking" mechanisms whereby the lateral positions of the towers can be adjusted prior to installation of the horizontal base frame. The walking mechanisms can be coupled for cooperative actuation to facilitate lateral movement of the completed rig base structure.

A drill floor can then be constructed over the horizontal base frame of the rig base structure. The drill floor may comprise multiple slab sections that are anchored to each other after being positioned over the base frame to form an integral drill floor structure. Optionally, the horizontal base frame can be advantageously set at a height above ground corresponding to the level of a flatbed truck or trailer, thus facilitating unloading of drill floor sections by shifting them laterally off the trailer bed onto the base frame. The drill floor is mated to the towers with suitable guide means such that the drill floor can be uniformly elevated relative to the towers along a linear vertical path, with the towers acting to provide lateral stability to the drill floor at all stages of the floor-elevating process. When the drill floor has been elevated to the required elevation, it is locked to the towers by any suitable means, such as but not limited to hydraulic clamps.

In a preferred embodiment, the drill floor is elevated using only the rig's traveling block and drawworks. To enable this mode of operation, sheave assemblies are mounted to and under the drill floor adjacent to each tower. Each tower has a floor-lifting cable anchored to an upper region of the tower and disposable under and around the corresponding sheave assembly associated with the drill floor, such that the free (i.e., non-anchored) ends of the floor-lifting cables converge toward a central area of the drill floor. After the rig mast has been erected using the traveling block and drawworks, the free ends of all floor-lifting cables can be engaged by the traveling block hook. The drawworks can then be actuated to raise the drill floor in one continuous operation.

BRIEF DESCRIPTION OF THE DRAWINGS

Embodiments in accordance with the present disclosure will now be described with reference to the accompanying figures, in which numerical references denote like parts, and in which.

DETAILED DESCRIPTION

Figure 1:
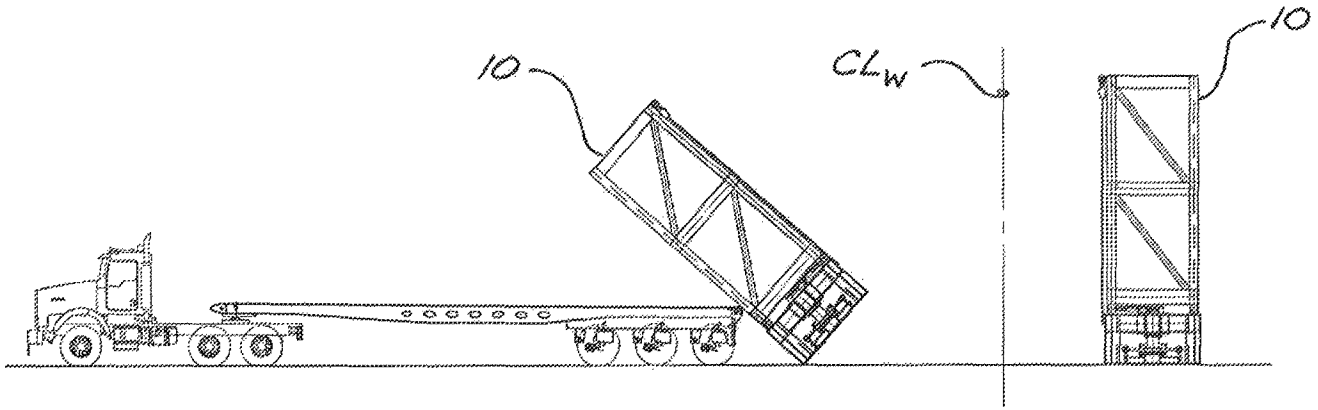
FIG. 1 is an elevation illustrating the unloading of base towers from a transport truck and positioning of the towers on a wellsite.
Figure 2:
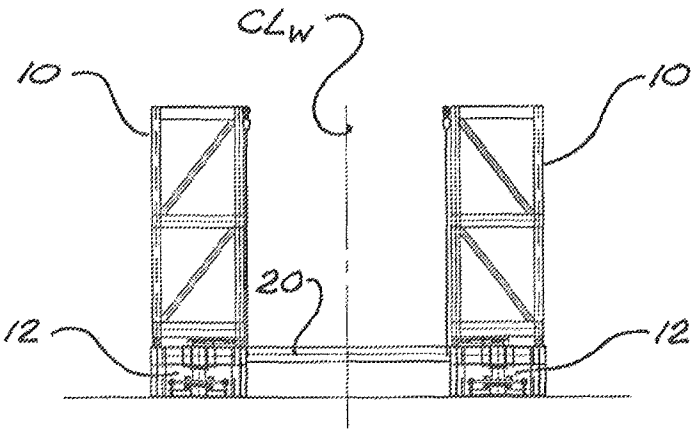
FIG. 2 is an elevation illustrating a horizontal base frame interconnecting the rig towers.

FIGS. 1 through 5B progressively illustrate the steps involved in assembling one embodiment of a transportable drilling rig in accordance with present disclosure. FIGS. 1 and 2 depict the delivery and positioning of a plurality of base towers 10 at a drill site. Preferably (but not necessarily), towers 10 will be provided with adjustment means 12 for adjusting their height, lateral position, and vertical alignment. Persons skilled in the art will know that such means can be provided in a variety of ways using known technologies, and such means do not constitute components of the broadest embodiments of drilling rigs in accordance with this disclosure.

After the required number of towers 10 are in their required positions relative to the centerline $CL_w$ of a wellbore to be drilled using the rig being constructed, a base frame 20 is constructed or installed as shown in FIG. 2, interconnecting the base towers 10. Base frame 20 can be of any suitable layout and structural configuration. The structure can also be assembled off the well and "walked" into drilling position if equipped with adjustment means 12.

As seen in FIG. 3, a drill floor 30 is then constructed over and temporarily supported on base frame 20, whereupon a rig mast structure 100 can be erected upon drill floor 30. The structural details of the rig mast and the methods by which it is erected are not directly relevant to the subject matter sought to be protected hereby. For illustration purposes, however, rig mast 100 is shown as a bootstrap mast of the type described previously herein, comprising:

- a bottom mast section 110 with support legs 112 and 114 anchored at their lower ends 112L and 114L to corresponding anchorages 112X and 114X on drill floor 30;
- a top mast section 120 fitted with a crown block 122 and traveling block 124 (as previously described); and
- one or more intermediate mast sections 130 adapted for connection to top mast section 120 and adjacent mast sections 130 (as previously described).

Figure 3A:
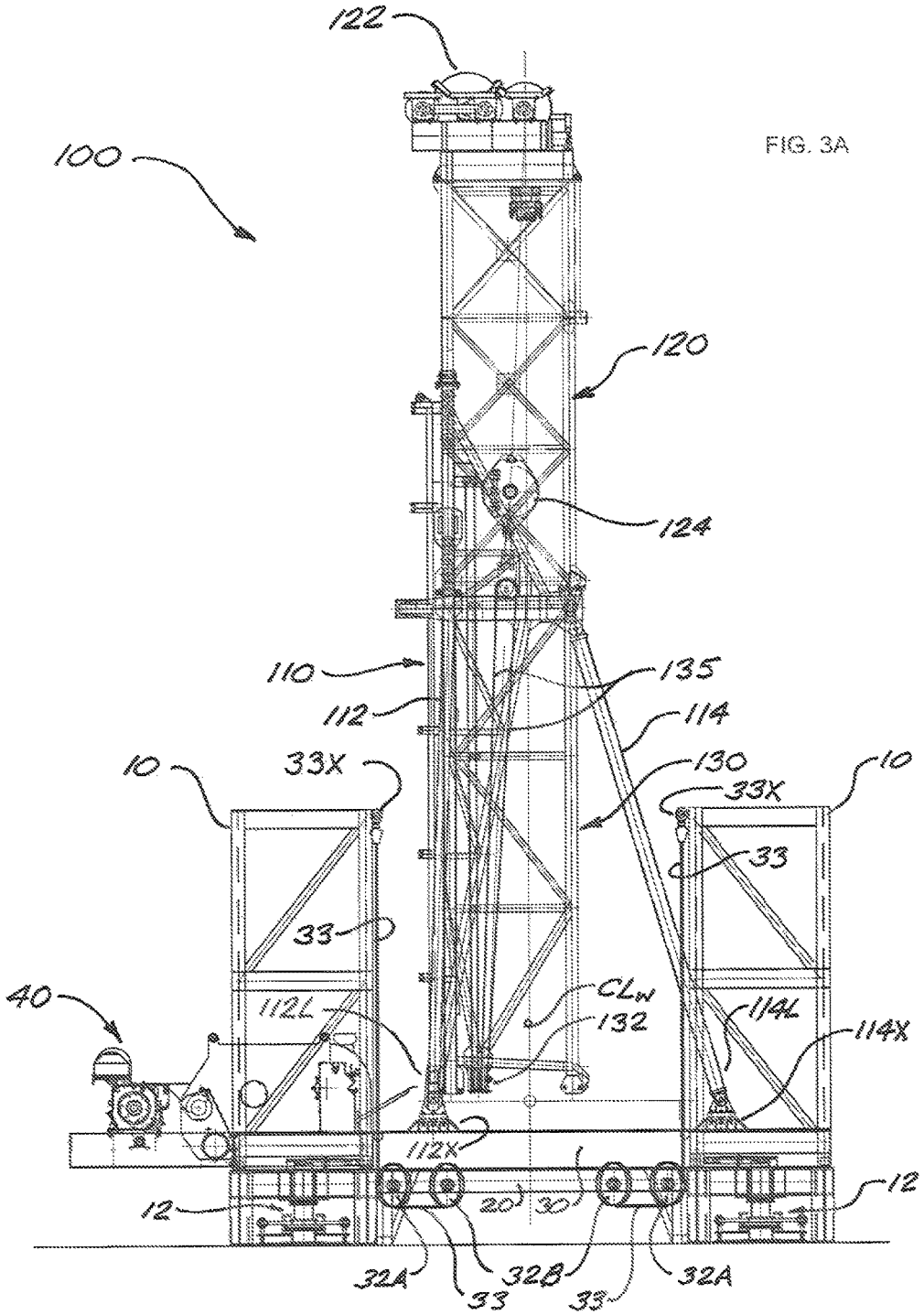
FIG. 3A is a first elevation view of an embodiment of a drilling rig structure in accordance with the present disclosure, showing the drill floor installed over the horizontal base frame, with a rig mast in an early stage of erection upon the drill floor.
Figure 6:
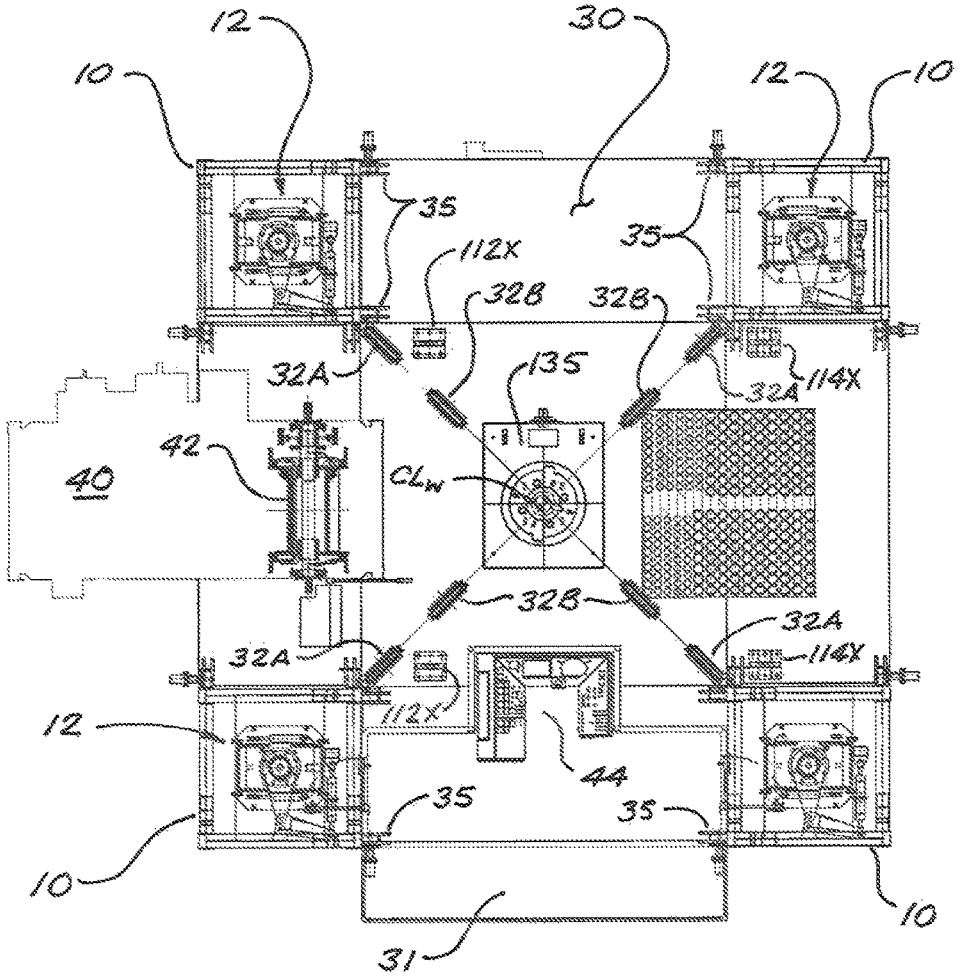
FIG. 6 is a plan cross-section through the base towers of one embodiment of a drilling rig structure and drill floor layout in accordance with the present disclosure, prior to elevation of the drill floor.

As seen in FIG. 3A and in greater detail in plan view in FIG. 6, drill floor 30 is provided with a suitable drawworks (generally indicated by reference number 40), including a cable drum 42 which carries wire rope used for a drill line fed up and through crown block 122 and down to traveling block 124 as previously described. In the embodiment illustrated in FIG. 6, the rig structure includes four base towers 10 laid out in a rectilinear pattern. Drill floor 30 is configured in the general shape of a cross, with adjacent "arms" of the cross fitted closely around their associated base tower 10. Reference numbers 35 denote drill floor guide and anchorage means to facilitate stable and uniform vertical movement of drill floor 30 relative to base towers 10 during drill floor lifting operations, and for anchoring drill floor 30 to base towers 10 after drill floor 30 has been elevated to its intended position for drilling operations. Although indicated for convenience by a single reference number 35, the drill floor guide means and the drill floor anchorage means may be separate and independent mechanisms.

The location and general configuration of the drawworks (including cable drum 42) are indicated by reference number 40; in the illustrated embodiment, drawworks 40 is at least partially installed on a cantilevered section of drill floor 30. In the illustrated embodiment, drill floor 30 incorporates a rotary table 135 for rotating a drill string. A driller's control cabin is indicated by reference number 44. Drill floor 30 may have one or more cantilevered catwalks 31 for worker access.

Mounted to (and typically underneath) drill floor 30 are a plurality of sheave assemblies for use in elevating drill floor 30. For clarity in this patent document, the sheaves used for this particular purpose will be referred to as drill floor sheaves. One exemplary drill floor sheave arrangement is illustrated in FIGS. 3A through 5B, and in greater detail in FIG. 6. In this exemplary arrangement, an outer drill floor sheave 32A and an inner drill floor sheave 32B are provided in association with each base tower 10, with the rotational axes of inner and outer drill floor sheaves 32A and 32B being parallel and transverse to a radial line extending from their associated base tower 10 to well centerline $CL_w$. Although drill floor sheaves 32A and 32B in the illustrated embodiment are actually mounted below or within the structure of drill floor 30, they are shown in solid outline in FIG. 6 for purposes of clarity.

In the illustrated embodiment, there is a set of drill floor sheaves for each base tower 10, but this is not essential. Alternative embodiments could have one or more base towers 10 that do not have associated drill floor sheave assemblies. Furthermore, although in the illustrated embodiment each drill floor sheave assembly includes a pair of drill floor sheaves, alternative embodiments could use drill floor sheave assemblies comprising more than two drill floor sheaves or possibly only one drill floor sheave.

Figure 3B:
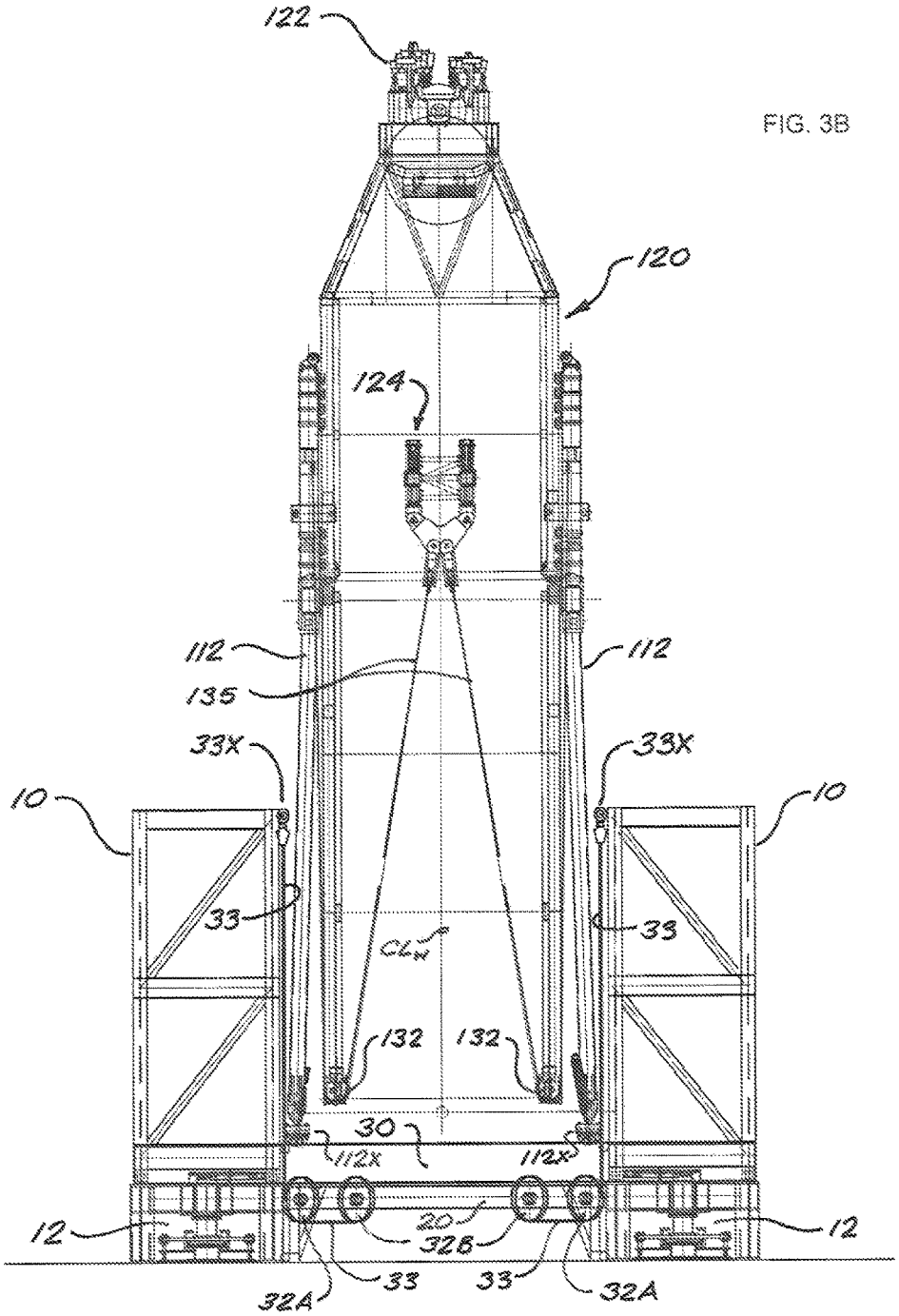
FIG. 3B is a second elevation view of the assembly in FIG. 3A.
Figure 4A:
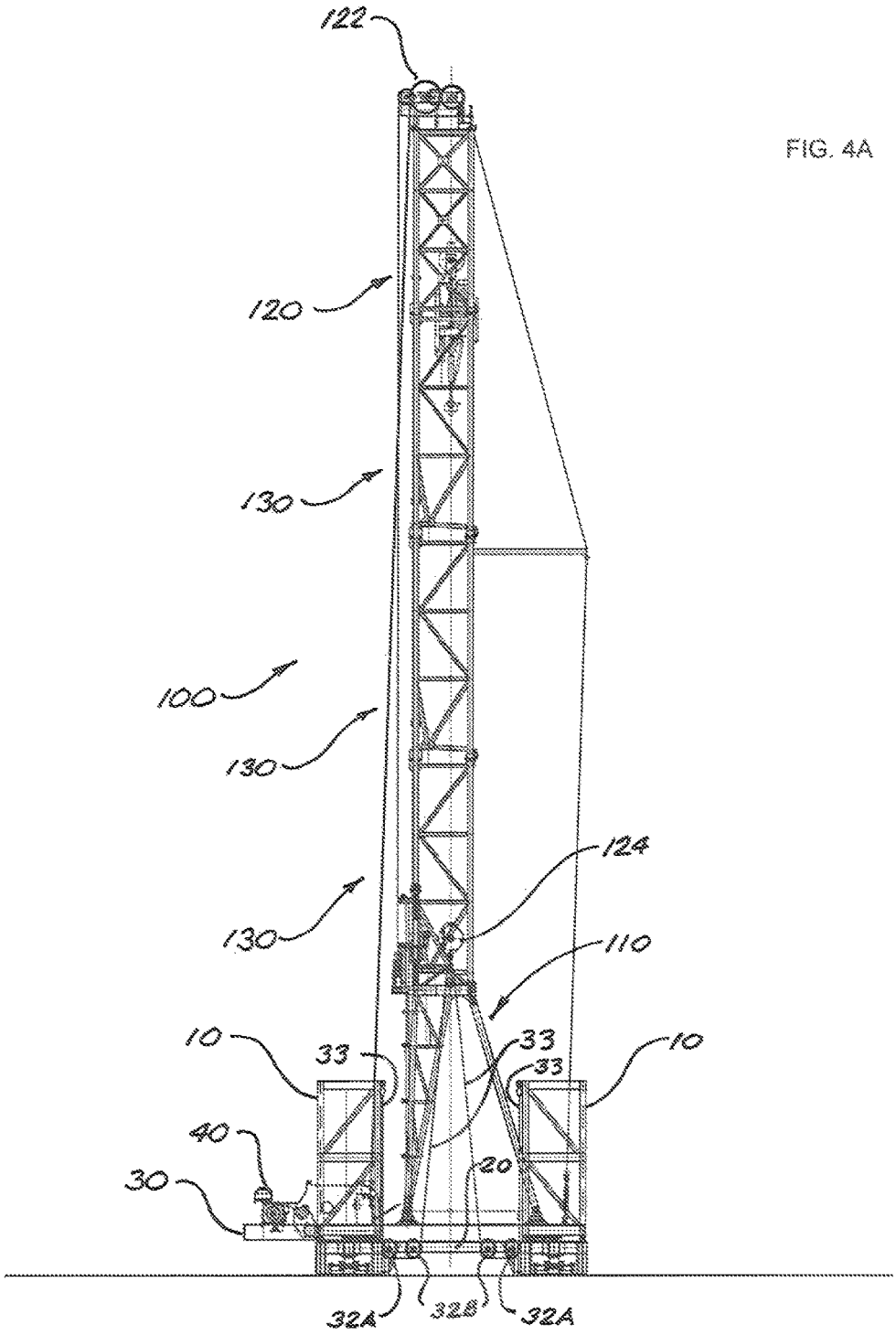
FIG. 4A is a first elevation view similar to FIG. 3A, after complete erection of the rig mast, with the floor-lifting cables engaging the traveling block hook in preparation for elevating the drill floor.
Figure 4B:
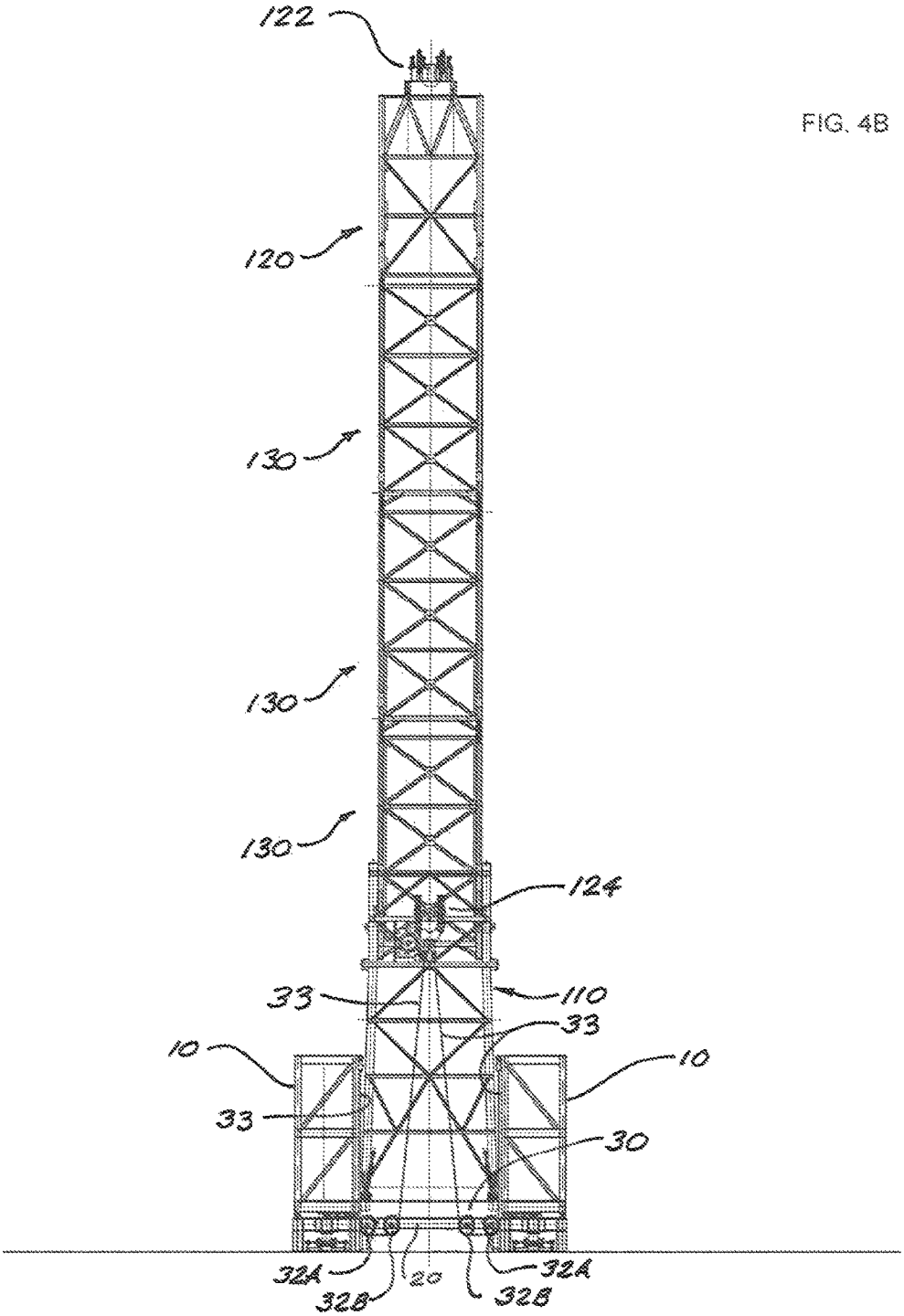
FIG. 4B is a second elevation view of the assembly in FIG. 4A.

In FIGS. 3A and 3B, upper mast section 120 has been positioned and pinned to bottom mast section 110, and a first intermediate mast section 130 has been positioned within bottom mast section 110 and connected to upper mast section 120. As seen with particular clarity in FIG. 3B, mast-raising cables 135 anchored to upper regions of bottom mast section 110 extend around sheaves 132 at the lower end of the intermediate mast section 130 disposed within bottom mast section 110, and upward for engagement with traveling block 124. Drawworks 40 is then actuated to raise traveling block 124 and lift the assembly of upper mast section 120 and intermediate mast section 130 until the lower end of intermediate mast section 130 has been raised sufficiently to allow another intermediate mast section 130 to be positioned within bottom mast section 110, and so on until rig mast 100 has been constructed to its final intended height as shown in FIGS. 4A and 4B.

Figure 5A:
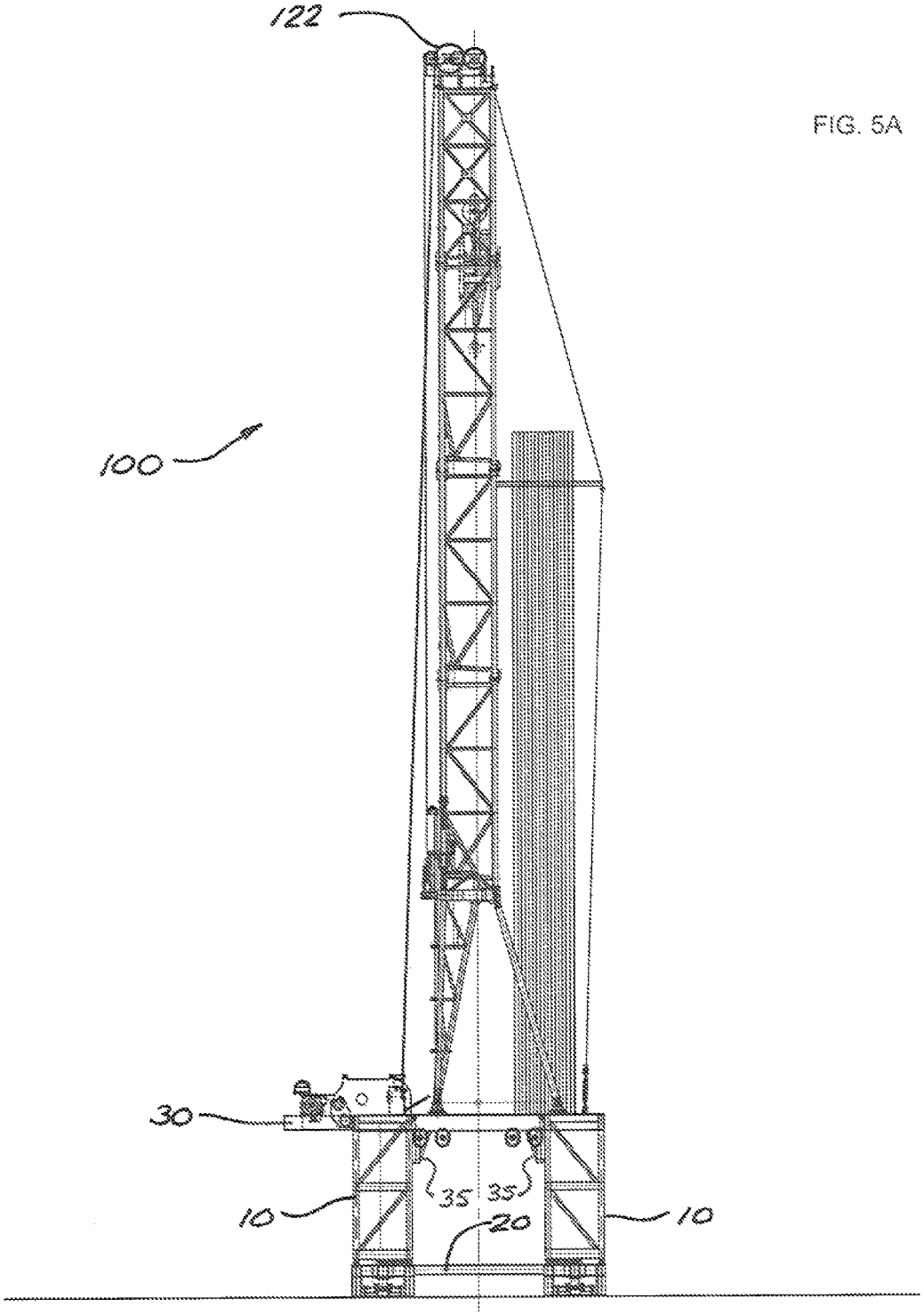
FIG. 5A is a first elevation view similar to FIG. 4A, after the drill floor has been elevated and the rig is ready to be put into service.
Figure 5B:
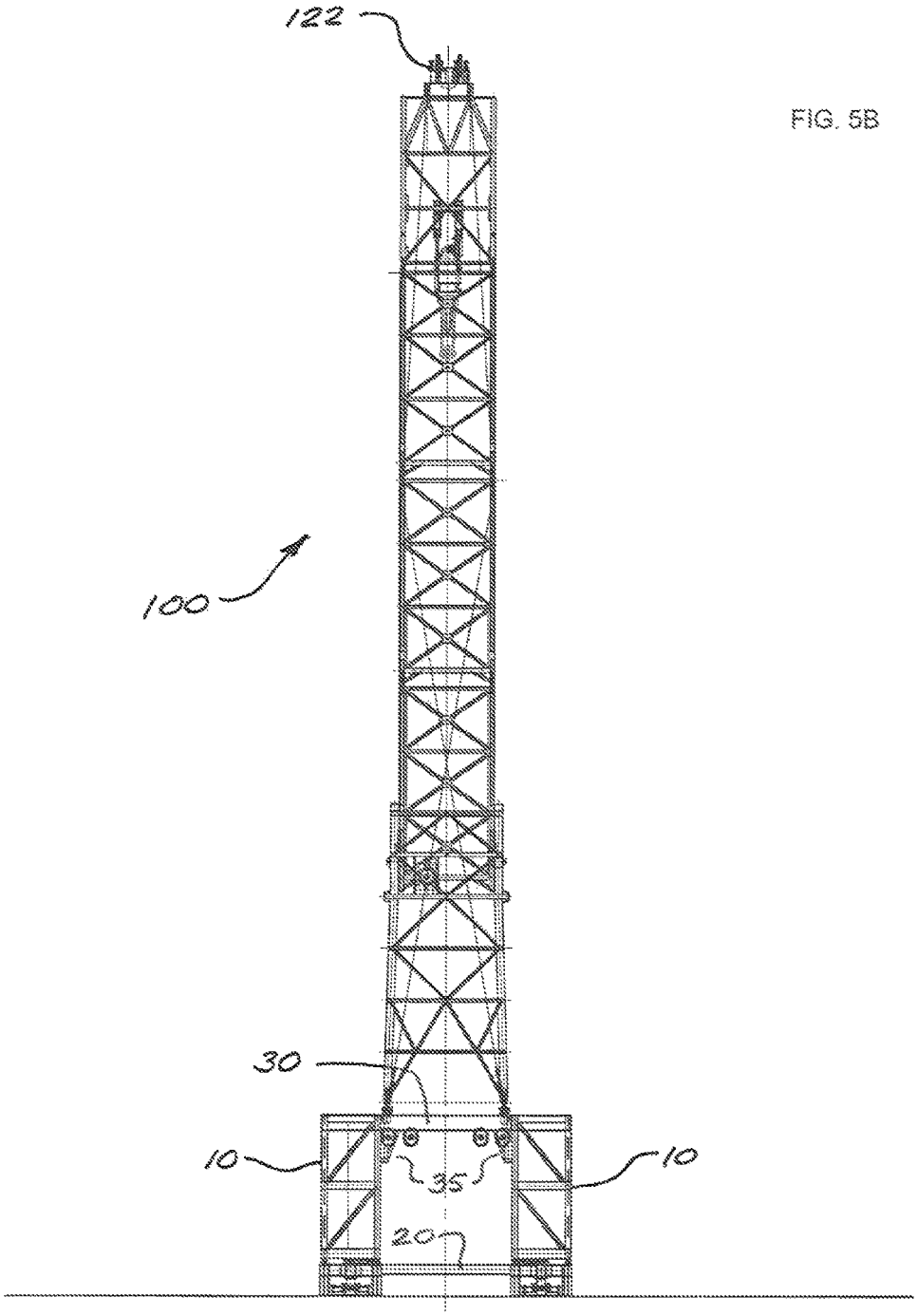
FIG. 5B is a second elevation view of the assembly in FIG. 5A.

At this stage, the mast-raising cables 135 are disengaged from traveling block 124. A plurality of floor-lifting cables 33, corresponding in number to the number of drill floor sheave assemblies, are threaded from anchor points 33X in upper regions of their associated base towers 10, around drill floor sheaves 32A and 32B, and then upward for engagement by traveling block 124, all as seen in FIGS. 4A and 4B. Drawworks 40 is then actuated to raise traveling block 124, thereby elevating drill floor 30, along a linear vertical path, to an intended service elevation as seen in FIGS. 5A and 5B. Drill floor 30 is then anchored to base towers 10 by suitable anchorage means 35 (which by way of non-limiting example could be provided in the form of hydraulic latches).

It will be readily apparent from the Figures that the path followed by drill floor 30 as it being elevated is a linear vertical path. FIGS. 3A and 4A are side views illustrating an embodiment of the drilling rig apparatus with drill floor 30 at its lowermost position. FIG. 5A is a side view (from the same angle as FIGS. 3A and 4A) showing the drilling rig apparatus after drill floor 30 has been elevated. FIGS. 3B, 4B, and 5B correspond to FIGS. 3A, 4A, and 5A, respectively, except that they show the apparatus from a different angle (90 degrees from the viewing angle in FIGS. 3A, 4A, and 5A). It is visually apparent from these Figures that drill floor 30 in its elevated position (per FIGS. 5A and 5B) is directly above its lowermost position (per FIGS. 3A, 3B, 4A, and 4B), with no lateral (i.e., horizontal) displacement relative thereto. It is also readily apparent from the Figures that no lateral displacement of drill floor 30 occurs at any stage of the floor-lifting process. Furthermore, and as is particularly clear from the plan view of drill floor 30 in FIG. 6, base towers 10 constrain drill floor 30 against any lateral displacement during the floor-elevating process, ensuring that the path followed by drill floor 30 during this process is a linear vertical path.

Although the drawworks and traveling block are used to elevate drill floor 30 for purposes of embodiments illustrated herein and previously described, alternative embodiments of rig systems in accordance with the present disclosure could use different means for elevating drill floor 30. By way of non-limiting example, a worm gear drive unit could be used to elevate drill floor 30, with guide rollers and mating racks built into base towers 10 at each corner of drill floor 30. The worm gear drive mechanism could be actuated by any suitable power means, such as hydraulic or electric motors. In one alternative embodiment, a worm gear drive could be provided as a supplement or back-up to a primary cable-implemented floor-lifting mechanism.

It will be readily appreciated by those skilled in the art that various modifications to embodiments in accordance with the present disclosure may be devised without departing from the scope and teaching of the present teachings, including modifications which may use equivalent structures or materials hereafter conceived or developed. It is to be especially understood that the scope of the present disclosure is not intended to be limited to described or illustrated embodiments, and that the substitution of a variant of a claimed element or feature, without any substantial resultant change in functionality, will not constitute a departure from the scope of the disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Relational terms such as "parallel" and "horizontal" are not intended to denote or require absolute mathematical or geometric precision. Accordingly, such terms are to be understood in a general rather than precise sense (e.g., "generally parallel" or "substantially parallel") unless the context clearly requires otherwise.

Wherever used in this document, the terms "typical" and "typically" are to be interpreted in the sense of representative or common usage or practice, and are not to be understood as implying invariability or essentiality.

What is claimed is:

1. A drilling rig system comprising:

(a) three or more base towers spaced apart so as to define a base area;

(b) a drill floor over at least a portion of the base area, said drill floor incorporating a plurality of floor-lifting sheave assemblies, each said floor-lifting sheave assembly being associated with a corresponding one of the base towers;

(c) drill floor guide means associated with the base towers, said drill floor guide means being adapted for engagement with the drill floor to facilitate uniform vertical movement of the drill floor relative to the base towers;

(d) a rig mast supported on and extending upward from the drill floor; and (e) floor-lifting means associated with the base towers, for lifting the drill floor and rig mast relative to the base towers, said floor-lifting means comprising:

a drawworks and traveling block associated with the rig mast; and a plurality of floor-lifting cables corresponding in number to the number of base towers, with each one of said floor-lifting cables being anchored to an upper region of an associated one of the base towers;

wherein the floor-lifting cables are threadable around their associated floor-lifting sheave assemblies to engage the traveling block, such that actuation of the drawworks will selectively cause the traveling block to move either upward or downward within the rig mast, thereby causing uniform vertical movement of the drill floor and the rig mast relative to the base towers.

2. A drilling rig system as in claim 1, further comprising locking means for locking the drill floor to the base towers to maintain the drill floor at a desired elevation.

3. A drilling rig system as in claim 2 wherein the locking means comprises hydraulic latches.

4. A drilling rig system as in claim 1, further comprising adjustment means for adjusting the vertical and lateral positions of the base towers.

5. A drilling rig system as in claim 1, further comprising a horizontal base frame disposed below the drill floor and interconnecting the base towers.

6. A drilling rig system as in claim 1, further comprising a horizontal base frame disposed below the drill floor and interconnecting the base towers.

7. A drilling rig system comprising:

(a) three or more base towers spaced apart so as to define a base area;

(b) a drill floor over at least a portion of the base area;

(c) drill floor guide means associated with the base towers, said drill floor guide means being adapted for engagement with the drill floor to facilitate uniform vertical movement of the drill floor relative to the base towers;

(d) a rig mast supported on and extending upward from the drill floor; and (e) floor-lifting means associated with the base towers, for lifting the drill floor and rig mast relative to the base towers, said floor-lifting means comprising a plurality of worm gear drive mechanisms and a plurality of mating rack gears, with each rack gear being incorporated into one of the base towers, and with each worm gear drive mechanism being incorporated into the drill floor adjacent to an associated rack gear;

such that actuation of the floor-lifting means will selectively cause the traveling block to move either upward or downward within the rig mast, thereby causing uniform vertical movement of the drill floor and the rig mast relative to the base towers.

8. A drilling rig system as in claim 7, further comprising locking means for locking the drill floor to the base towers to maintain the drill floor at a desired elevation.

9. A drilling rig system as in claim 8 wherein the locking means comprises hydraulic latches.

10. A drilling rig system as in claim 7, further comprising adjustment means for adjusting the vertical and lateral positions of the base towers.

11. A drilling rig system comprising:

(a) three or more base towers spaced apart in a selected layout;

(b) a horizontal base frame interconnecting lower regions of the base towers to form a base structure;

(c) a drill floor overlying the base frame and vertically movable relative thereto, said drill floor incorporating a plurality of floor-lifting sheave assemblies, each said floor-lifting sheave assembly being associated with one of the base towers;

(d) a rig mast on the drill floor;

(e) a drawworks and traveling block associated with the rig mast;

(f) a plurality of floor-lifting cables, each floor-lifting cable being associated with one of the base towers, with a first end of each floor-lifting cable being anchored to an upper region of the associated base tower, with each floor-lifting cable being threaded around the floor-lifting sheave assembly of its associated base tower, and with a second end of each cable engaging the traveling block; and (g) drill floor guide means adapted for mating the drill floor to the base towers such that actuation of the drawworks will selectively cause the traveling block to move either upward or downward within the rig mast, thereby lifting the drill floor relative to the base structure until the drill floor is at a desired elevation, with the drill floor guide means facilitating uniform vertical movement of the drill floor relative to the base towers, and with the base towers providing lateral stability to the drill floor.

12. A drilling rig system as in claim 11, further comprising locking means for locking the drill floor to the base towers to maintain the drill floor at the desired elevation.

13. A drilling rig system as in claim 12 wherein the locking means comprises hydraulic latches.

14. A drilling rig system as in claim 11, further comprising adjustment means for adjusting the vertical and lateral positions of the base towers.

* * * * *